United States Patent [19]

Bohan, Jr.

[11] Patent Number: 4,560,343

[45] Date of Patent: Dec. 24, 1985

[54] FUNCTIONAL CHECK FOR A HOT SURFACE IGNITOR ELEMENT

[75] Inventor: John E. Bohan, Jr., Minneapolis, Minn.

[73] Assignee: Honeywell Inc., Minneapolis, Minn.

[21] Appl. No.: 619,527

[22] Filed: Jun. 11, 1984

[51] Int. Cl.[4] ..... F23N 5/00

[52] U.S. Cl. ..... 431/66; 431/25

[58] Field of Search ..... 431/66, 25, 6, 12, 80, 431/24; 340/579; 361/264

[56] References Cited

U.S. PATENT DOCUMENTS

| | | | |
|---|---|---|---|
| 3,871,814 | 3/1975 | Das et al. | 431/66 |
| 4,245,977 | 1/1981 | Morese | 431/25 X |
| 4,298,335 | 11/1981 | Riordan et al. | 431/25 |
| 4,323,342 | 4/1982 | Sommers, Jr. et al. | 431/66 |
| 4,405,299 | 9/1983 | Serber | 431/78 |
| 4,444,551 | 4/1984 | Muellar et al. | 431/66 X |

FOREIGN PATENT DOCUMENTS 51-156536 2/1976 Japan .

OTHER PUBLICATIONS

Installation and Instruction Sheet for a Hot Surface Ignition Control S89C as manufactured by Honeywell Inc., Form Number 68-0044-1.

*Primary Examiner*—Randall L. Green

*Attorney, Agent, or Firm*—Alfred N. Feldman

[57] ABSTRACT

A hot surface ignitor element is functionally checked for continuity and operating temperature. This check is accomplished by initially energizing the hot surface ignitor element and then switching it as a single ended element into a series circuit with a source of potential. The potential is applied between the hot surface ignitor and an electrode which is connected back to the source of potential. If the hot surface ignitor has come up to ignition temperature a flame rectification signal is simulated.

11 Claims, 5 Drawing Figures

FUNCTIONAL CHECK FOR A HOT SURFACE IGNITOR ELEMENT

BACKGROUND OF THE INVENTION

For many years gas fired furnaces and appliances have used an ignition source referred to as a standing pilot. A standing pilot arrangement provides for a continuously burning flame adjacent the burner for the appliance. The standing pilot is usually monitored with a thermocouple or other heat sensing elements, and is very inexpensive and reliable in operation. With the advent of the rapid increase in the cost of fuels, attempts have been made to find other means for igniting burners in furnaces and appliances, such as water heaters. This search for an alternate ignition arrangement has been mandated in some localities by legislation which makes a standing pilot for ignition in new equipment a violation of law.

Two alternative ignition sources have been known for many years. The source which was most easily implemented was a source normally referred to as a spark ignition source. A spark ignition source is a spark gap across which a high potential is applied. A spark jumping the gap acts as an ignition source for gaseous fuels, and has been used in many installations where a standing pilot is impractical or is now illegal. Spark ignition systems have certain drawbacks. A spark ignition system tends to generate radio frequency interference because of the nature of spark ignition equipment, and the spark also generates an audible noise that is distracting and undesirable.

A third type of ignition source has been used to a limited degree, and is a hot surface ignitor arrangement. A hot surface ignitor can be a loop or coil of high resistance wire that is energized to cause the wire to glow. This type of element has a number of drawbacks. One of the drawbacks is the fragile nature of the wire and its mounting. Another drawback is its very short life.

Other types of hot surface ignitors have been under development for a number of years. Typically they are ceramic elements that have a U-shaped configuration, or a serpentine configuration, to provide a resistance element that will glow to incandescence when an appropriate voltage is applied. Typically, the voltage applied to ceramic type elements is line voltage. These elements are normally made of silicon carbide, and provide a substantial mass that can be brought to a glowing level of heat for ignition of gaseous fuels. The silicon carbide and similar types of ignitors have many of the deficiencies of the other hot surface ignitor elements. They tend to have a limited life and are also quite fragile.

In using any of the hot surface ignition devices, it is desirable to be able to determine whether the ignitor, in fact, has reached an ignition temperature thus indicating that it has not been broken or fractured. Early attempts to use hot surface ignitors have used current measuring circuitry that, in one way or another, measured the current flow to the hot surface ignitor. The measurement of current was then converted into an indication of whether or not the hot surface ignitor had electrical continuity. If electrical continuity existed, that indication along with the level of current flow could be used as a measure of whether the hot surface ignitor in fact was reaching an ignition temperature for the fuel being used. This type of circuit arrangement is very costly to implement, and therefore has in many cases limited the use of hot surface ignitors as an ignition source for gaseous fuels. It is quite obvious that this type of arrangement would not have the noise problems, either electrical or audible, and therefore might be more desirable than a spark ignition source for gaseous fuel ignition.

A typical Hot Surface Ignition Control system is manufactured and sold by Honeywell under the type number S89C. This type of system utilizes electronic controls for the energization of the hot surface ignitor and the subsequent opening of a fuel or gas valve to a burner in a furnace or similar appliance. Devices such as the Honeywell S89C typically used a fixed time interval of energization of a hot surface ignitor for the generation of sufficient heat in the hot surface ignitor, and then the fuel or gas valve was opened. Only after the gas valve was opened and an absence of flame was detected, did the system know that the ignitor was not functioning properly. At this point the system would automatically shut down.

SUMMARY OF THE INVENTION

A hot surface ignitor element, such as a silicon carbide element, can be verified for operation prior to the opening of a gas valve in a very reliable and inexpensive manner. It has been found that if a hot surface ignitor, such as a silicon carbide ignitor, is energized for a sufficient period of time at its designed operating voltage, that the element will glow at a temperature sufficient to ignite a gaseous fuel. If the element is then disconnected from its normal energizing source, and is in turn connected in a series circuit between a source of potential and a circuit element or electrode adjacent to the ignitor, a low level of current can be sensed between the ignitor and the circuit element even though no flame is present.

In past applications a flame had to be present in order to detect a flame rectified signal. In the present invention it has been found that by heating the hot surface ignitor element to an ignition temperature, and then applying a proper voltage to the ignitor, that a current would flow between the ignitor and an electrode thereby indicating that the hot surface ignitor had reached the ignition temperature. This also proves continuity, as there could be no heating of the element if continuity did not exist.

With the present invention, it is possible to energize a hot surface ignitor element and then check conclusively that the element in fact had reached the desired temperature. This arrangement would allow for the safe operation of a gas fired appliance without the opening of a fuel valve prior to actually checking to make sure that a source of ignition is present when the valve is opened.

The present arrangement has been found to work very well with a hot surface ignitor of the silicon carbide type when energized by 110 volts for an appropriate period of time. A voltage is then applied to the ignitor element through a current measuring device, such as a microammeter, and a current can be detected if an electrode means is placed adjacent to the silicon carbide ignitor and is connected back to the other side of the potential source. In practice, it has been found that a flat plate placed at a distance of no more than approximately three-sixteenths of an inch from the silicon carbide ignitor provides a reliable signal when the hot surface ignitor has reached an ignition temperature. The theory of operation of this arrangement can be speculated to be comparable to a flame rectification arrangement, but with the absence of flame as the conducting medium.

In accordance with the present invention, there is provided a system for functionally checking for continuity and operating temperature of a hot surface ignitor element in a burner for a fuel, including: a resistive hot surface ignitor element having two ends and connection means with said ends adapted to be connected by said connection means to a source of power to draw a current in said system that in turn heats said element to a temperature capable of ignition of said fuel; electrode means placed adjacent said hot surface ignitor element; and current responsive means connected by said connection means to said source of power, one end of said hot surface ignitor element, and said electrode means; said current responsive means responding to a current flow between said hot surface ignitor element and said electrode means upon said hot surface ignitor element having reached a sufficient temperature to ignite said fuel.

There is further provided in accordance with the present invention a method for functionally checking for continuity and operating temperature of a hot surface ignitor element having electrode means adjacent said hot surface ignitor element in a burner for a fuel including: connecting said hot surface ignitor element to a source of power to cause said hot surface ignitor element to heat to an ignition temperature of said fuel for said burner; connecting said hot surface ignitor element in a circuit with current responsive means, said electrode means, and said source of power; and said current responsive means responding to a sufficient current flow between said hot surface ignitor element and said electrode means as an indication that said hot surface ignitor element has reached an ignition temperature for said fuel.

DESCRIPTION OF THE PREFERRED EMBODIMENTS

Figure 1:
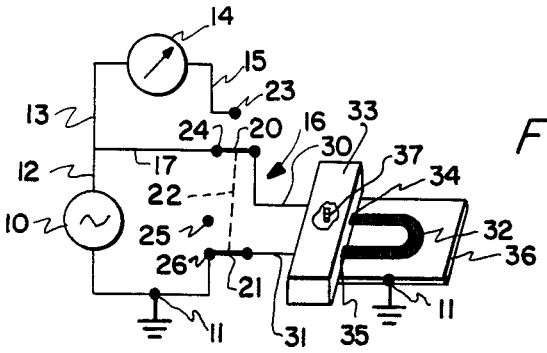
FIG. 1 is a schematic representation showing the principle involved.

FIG. 1 is a highly simplified schematic diagram for purposes of explaining the concept of the present invention. A source of potential 10, in the form of a conventional line voltage alternating current source, is disclosed. One side of source 10 is grounded at 11. Source 10 has an output conductor 12 that is connected by a conductor 13 to a microammeter 14. The microammeter 14 has a further conductor 15 that is connected to a connection means generally disclosed at 16. The connection means 16 includes a double pole, double throw switch. Two moveable elements 20 and 21 are ganged together at 22 so that the moveable elements 20 and 21 can be moved between terminals 23, 24, 25, and 26. The terminal 23 is connected to the microammeter 14 by conductor 15. The terminal 24 is connected to the conductor 12 by conductor 17. The terminal 25 is an unused terminal, and the terminal 26 is connected to ground 11. The moveable element 20 is connected to a conductor 30, while the moveable element 21 is connected to a conductor 31.

A hot surface ignitor element 32 is disclosed as clamped into an insulating block 33 by a fastener means 34. The conductor 30 connects to one end 34 of the hot surface ignitor element 32 while the conductor 31 connects to the other side 35 of the hot surface ignitor element 32. The structure is completed by the addition of electrode means 36, that is a conductive plate mounted by the fastener means 34 to the insulator 33. The electrode means 36 is parallel to the mass of the hot surface ignitor element 32 and is in close proximity thereto. In a test installation, the electrode means 36 was a plate that was mounted at approximately ⅛ inch distance from the hot surface ignitor element 32. Other shapes of electrode means 36 could be used. The electrode means 36 is grounded at 11 so that a common ground between the electrode means 36 is provided to the ground of the source 10. The hot surface ignitor element 32 can be any type of hot surface ignitor, but in an experimental arrangement the hot surface ignitor element 32 was a silicon carbide ignitor of a commercially available design. The hot surface ignitor element can be U-shaped, spiral in configuration, or sinuous in configuration. All of these types of configurations are known, but in each case the mass used for ignition is generally parallel and adjacent to the electrode means 36.

OPERATION OF FIG. 1

The principle of operation can be readily understood by considering the structure of FIG. 1. The switch elements 20 and 21 are initially placed in the position shown in FIG. 1 where the power source 10 is connected directly across the ends 34 and 35 of the hot surface ignitor element 32. With this arrangement the hot surface ignitor element will come up to a red glow indicating that the ignitor is sufficiently hot to ignite gaseous fuels. If at this time the connection means 16 is operated to the position where the moveable element 20 connects terminal 23 to conductor 30, and the moveable element 21 connects the terminal 25 to the end 31, a second mode of operation is developed. In the second mode it will be noted that a complete series circuit exists from the ground 11, through the source means 10, to the conductor 13 and the microammeter 14. The series circuit continues from the conductor 15 through the moveable member 20 to the conductor 30 and the end 34 of the hot surface ignitor element 32. It will be noted that the other end 35 of the hot surface ignitor element 32 is open circuited. It would be normally assumed that no current would flow. It has been found, however, that current flows between the hot surface ignitor element 32 and the electrode means 36 to ground 11 thereby completing an electric circuit. This electric circuit is completed only if the hot surface ignitor element 32 has become sufficiently hot to ionize the air in its vicinity. This proves two critical points. First, it proves that the hot surface ignitor 32 had continuity when it was energized across the source 10, and second that the hot surface ignitor element 32 was raised to a sufficient temperature to ignite fuel. It has been found experimentally that the electrode means 36 will work up to distances of approximately three-sixteenths of an inch with a commercially available hot surface ignitor element 32.

With the arrangement of FIG. 1 in mind, it is possible to recognize that a check of continuity and a verification of the heating of the hot surface ignitor element 32 can be made. Since this information can be readily determined in a burner control system, this concept can then be used as the basis for a system that functionally checks the continuity and the operating temperature of a hot surface ignitor element in a burner for a fuel, such as a gaseous fuel, before the fuel is allowed to enter the combustion chamber.

Figure 2:
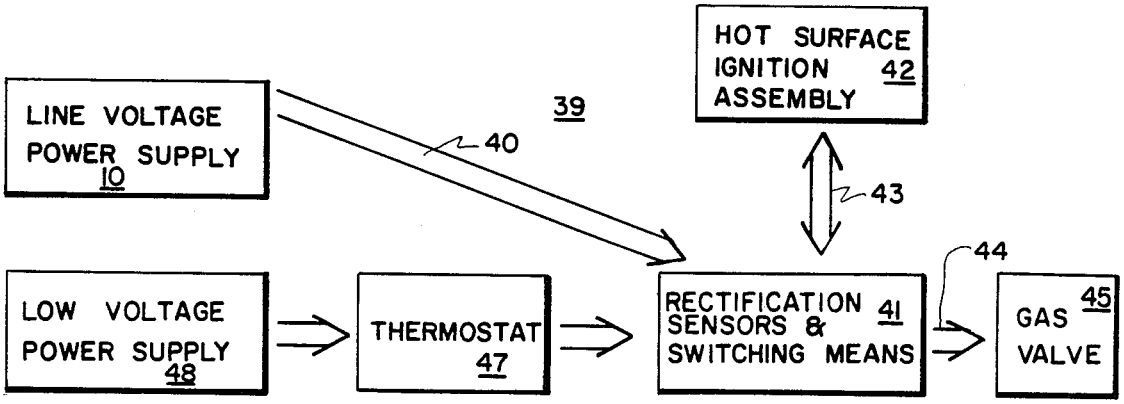
FIG. 2 is a block diagram of a complete system utilizing the present invention.

FIG. 2 discloses a block diagram of a burner system 39 capable of utilizing the present invention. The line voltage power source 10 is again provided and is represented at 40 as suppying power to a rectification sensor and switching means 41. The rectification sensor and switching means 41 can be any type of connection means and current responsive means. These means are comparable to the connection means 16 and the microammeter 14 of FIG. 1. A hot surface ignitor assembly 42 is disclosed, and would be comparable to the hot surface ignitor element 32 and the electrode means 36 along with the conductors 30 and 31 of FIG. 1. The conductors 30 and 31 typically would be represented at 43 as the means of connecting the hot surface ignitor assembly 42 to the rectification sensor and switching means 41. The rectification sensor and switching means 41 connect via any electrical means 44 to a gas or fuel valve 45 for a heating system.

The heating or control system generally disclosed at 39 has a thermostat 47 and a low voltage power supply 48. The low voltage power supply 48 typically would derive power from the line voltage power supply 10, and would be a step-down transformer to supply energy at the command of the thermostat 47 to cause the system to operate to safely open the gas valve 45.

Figure 3:
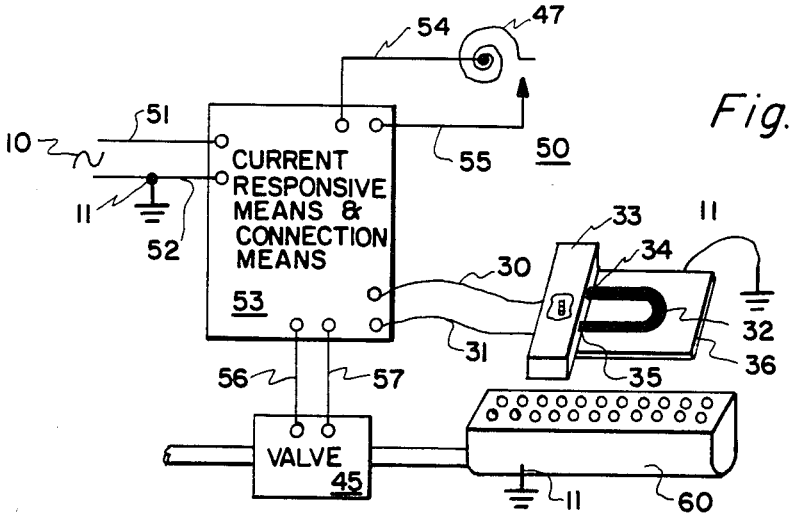
FIG. 3 is a diagram of a further system using the invention.

The system disclosed in FIG. 3 is a typical burner control system generally indicated at 50. A source of power 10 is provided and is grounded at 11. The source 10 supplies power on two conductors 51 and 52 to a current responsive means and connection means 53. The current responsive means and connection means 53 is connected by a pair of conductors 54 and 55 to the thermostat 47, shown in conventional form. The current responsive means and connection means 53 further has a pair of conductors 56 and 57 connected to a gas valve 45 that controls the flow of a gas fuel to a burner disclosed at 60. The burner is grounded at 11. The hot surface ignitor element of FIG. 1 completes FIG. 3 by the ignitor element 32 being connected to means 53.

OPERATION OF FIG. 3

The operation of the system disclosed in FIG. 3 is substantially the same as that in FIG. 2. Upon the closing of the thermostat 47 calling for the operation of the burner 60, power is supplied by the current responsive means and connection means 53 to the conductors 30 and 31 to energize the hot surface ignitor element 32. After the hot surface ignitor element 32 has been on for a set period of time, the current responsive means and connection means 53 switches, in a mode similar to that of FIG. 1, so as to apply a voltage between the hot surface ignitor element 32 and the ground plate 36 or ground 11. If the hot surface ignitor element 32 has, in fact, provided sufficient continuity and generates a sufficient heat, a small current of a rectified nature will flow from the current responsive means and connection means 53 through the hot surface ignitor element 32. The rectified current will flow to the electrode means 36. The flowing of this current proves the proper heating of the hot surface ignitor element 32, and energy is supplied on the conductors 56 and 57 to open the gas valve 45. The opening of gas valve 45 supplies fuel to the burner 60 where a flame is generated by the gas coming in contact with the hot surface ignitor element 32. At this point the system is in normal operation. The system can be continuously checked by known flame rectification principles. These principles are embodied in the prior mentioned Honeywell S89C Hot Surface Ignition Control. As such, the present invention could be adapted into this type of a control and provide for verification of the hot surface ignitor element 32 prior to opening the gas valve, as opposed to merely being an element that acts initially as an ignition source and subsequently as a flame rectification sensor.

Figure 4:
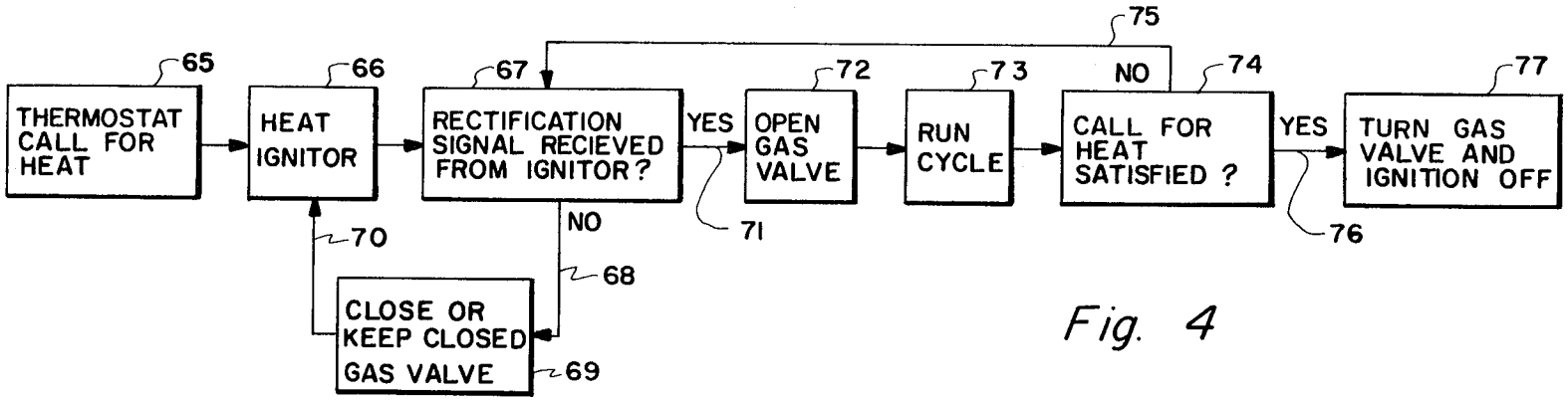
FIGS. 4 and 5 are flow charts of two different logic sequences using the inventive concept.
Figure 5:
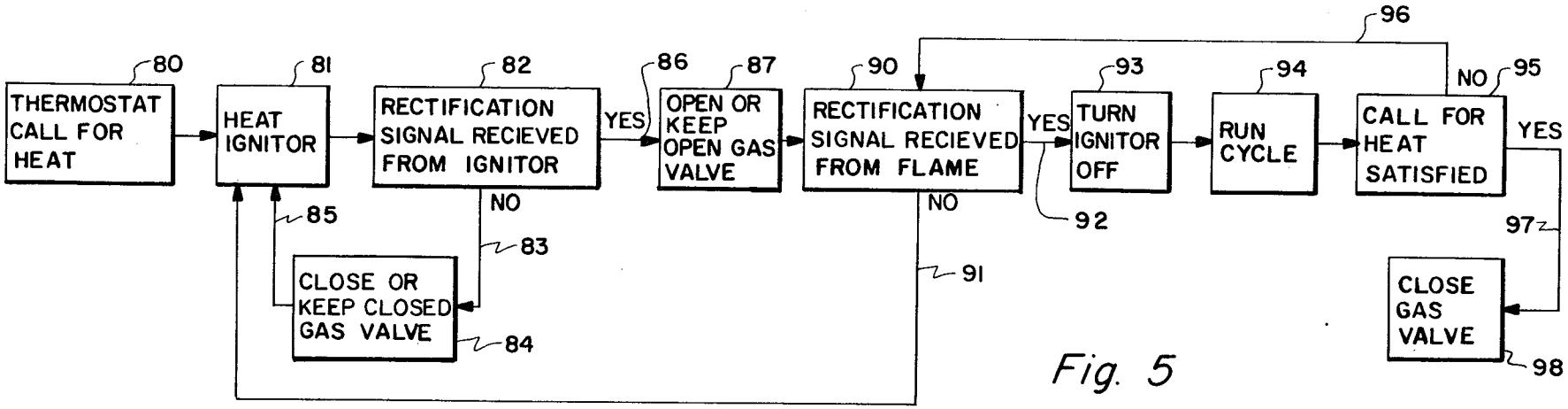

In FIGS. 4 and 5 flow charts disclosing two different operating sequences for systems utilizing the present concept are disclosed. The flow charts are substantially self-explanatory, but will be amplified briefly.

In FIG. 4 a thermostat calls for heat as indicated at 65. At 66 the ignitor is energized for some period of time. At 67 the system is operated to sense a simulated rectification signal between the hot surface ignitor element and the electrode means. If no such signal exists at 68, the logic 69 indicates that the gas valve is to remain closed. A signal 70 is sent back to 66 requesting additional heating. It is quite apparent at this point that the ignitor not only has been energized, but checked prior to the operation of a gas valve.

If a rectification signal from block 67 is present at 71, the gas valve opens at 72 and the system goes into a normal run cycle 73. At 74 the system constantly checks to determine whether the call for heat from the thermostat has been satisfied. If not at 75, the system continues to supply a rectification signal to keep the system calling for heat. If heat has been supplied to satisfy the thermostat at 76, the system turns off the gas valve at 77, and the system goes to standby waiting for the next call for heat.

In FIG. 5 a very similar type of sequence is provided except that the sequence has been adapted to not only check functionally for the continuity and operating temperature of the hot surface ignitor element, but also places the element in a flame rectification mode similar to the system disclosed in the Honeywell S89C Hot Surface Ignition Control. The sequence will be briefly described.

The thermostat calls for heat at 80 and that call for heat is applied at 81 to heat the hot surface ignitor element. The hot surface ignitor element provides a rectified signal at 82 after a set period of time. If the signal is not received at 83, the check 84 keeps the gas valve closed as indicated by the function 85.

If the rectification signal is received at block 82, a signal is provided at 86 to the logic block 87 that indicates that the valve is to be opened or kept opened. At 90 a rectification signal is verified. If no rectification signal is received at 91, the block 81 is reactivated to heat the ignitor. If a rectification signal is received at 92, the system is in normal operation and the device turns off the ignitor at 93. This function has been added to add life to the hot surface ignitor element. The hot surface ignitor element typically has a very limited life and by turning it off during the cycle of operation, its life can be extended. Even though the hot surface ignitor is turned off, it still functions as a flame rectification flame rod and continues to provide for a run signal 94 for the device.

After the system is up and running, a constant check for whether or not the call for heat has been satisfied is indicated at 95. If it is not at 96, the cycle continues in operation. If at 97 the call for heat has been satisfied the valve is turned off as indicated at 98.

It is quite apparent that the invention developed in FIG. 1 can be applied to many different configurations of actual operating systems. Systems have been shown of different configurations as examples of applications of this invention. The applicant wishes to be limited in the scope of his invention solely by the scope of the appended claims.

The embodiments of the invention in which an exclusive property or right is claimed are defined as follows:

1. A system for functionally checking for continuity and operating temperature of a hot surface ignitor element prior to introduction of a fuel in a burner, including: a resistive hot surface ignitor element having two ends; said ends adapted to be connected by connection means to a source of power to draw a current in said system that in turn heats said element to a temperature capable of ignition of said fuel; electrode means which is separate from said burner and placed adjacent said hot surface ignitor element; said ignitor element and said electrode means placed adjacent said burner to ignite fuel from said burner when said fuel is introduced to said burner; and current responsive means for functionally checking said hot surface ignitor element prior to introduction of a fuel into said burner connected by said connection means to said source of power, one end of said hot surface ignitor element, and said electrode means; said current responsive means responding to a current flow between said hot surface ignitor element and said electrode means upon said hot surface ignitor element having reached a sufficient temperature to ignite said fuel to functionally check said ignitor element prior to introduction of said fuel.

2. A system for functionally checking for continuity and operating temperature of a hot surface ignitor element as described in claim 1 wherein said electrode means includes a plate-like member.

3. A system for functionally checking for continuity and operating temperature of a hot surface ignitor element as described in claim 2 wherein said hot surface ignitor element includes a mass that is heated to an ignition temperature of said fuel; and said plate-like memeber is adjacent to and generally parallel to said mass.

4. A system for functionally checking for continuity and operating temperature of a hot surface ignitor element as described in claim 3 wherein said plate-like member and said mass are generally no further than three-sixteenths of an inch apart.

5. A system for functionally checking for continuity and operating temperature of a hot surface ignitor element as described in claim 4 wherein said hot surface ignitor element is a silicon carbide ignitor.

6. A system for functionally checking for continuity and operating temperature of a hot surface ignitor element as described in claim 1 wherein said current responsive means and said connection means are adapted to be connected to a thermostat and a fuel valve for said burner.

7. A system for functionally checking for continuity and operating temperature of a hot surface ignitor element as described in claim 6 wherein said fuel is gas.

8. A system for functionally checking for continuity and operating temperature of a hot surface ignitor element as described in claim 7 wherein said electrode means includes a plate-like member.

9. A system for functionally checking for continuity and operating temperature of a hot surface ignitor element as described in claim 8 wherein said hot surface ignitor element includes a mass that is heated to an ignition temperature of said fuel; and said plate-like member lies adjacent to and generally parallel to said mass.

10. A system for functionally checking for continuity and operating temperature of a hot surface ignitor element as described in claim 9 wherein said plate-like member and said mass are generally no further apart than three-sixteenths of an inch.

11. A system for functionally checking for continuity and operating temperature of a hot surface ignitor element as described in claim 10 wherein said hot surface ignitor element is a silicon carbide ignitor.

* * * * *